US005395747A

United States Patent [19]

Helland et al.

[11] Patent Number: 5,395,747

[45] Date of Patent: Mar. 7, 1995

[54] STABILIZED THERMAL-DYE-BLEACH CONSTRUCTIONS

[75] Inventors: Randall H. Helland, Lake Elmo; William D. Ramsden, Afton; Roger A. Mader, Stillwater, all of Minn.

[73] Assignee: Minnesota Mining & Manufacturing Company, St. Paul, Minn.

[21] Appl. No.: 170,536

[22] Filed: Dec. 20, 1993

[51] Int. Cl.[6] ..... G03C 1/498; G03C 1/83; G03C 1/815

[52] U.S. Cl. ..... 430/510; 430/339; 430/372; 430/513; 430/516; 430/517; 430/529; 430/533; 430/600; 430/613; 430/634

[58] Field of Search ..... 430/510, 513, 516, 517, 430/533, 613, 372, 600, 339, 634, 529

[56] References Cited

U.S. PATENT DOCUMENTS

| | | | |
|---|---|---|---|
| 3,220,846 | 11/1965 | Tinker et al. | 96/91 |
| 3,609,360 | 9/1971 | Wiese, Jr. | 250/65 T |
| 3,619,194 | 11/1971 | Mitchell | 96/84 |
| 3,627,527 | 12/1971 | Gilman et al. | 96/1.6 |
| 3,684,552 | 8/1972 | Wiese et al. | 117/36.8 |
| 3,769,019 | 10/1973 | Wiese, Jr. et al. | 96/84 R |
| 3,852,093 | 12/1974 | O'Leary | 117/36.8 |
| 4,033,948 | 7/1977 | Brown | 260/240 A |
| 4,060,420 | 11/1977 | Merkel et al. | 96/114.1 |
| 4,088,469 | 5/1978 | Schaefer | 65/5 |
| 4,088,497 | 5/1978 | Brown et al. | 96/114.1 |
| 4,196,002 | 4/1980 | Levinson et al. | 430/617 |
| 4,197,131 | 4/1980 | Lea et al. | 430/617 |
| 4,201,590 | 5/1980 | Levinson et al. | 430/617 |
| 4,283,487 | 8/1981 | Lea et al. | 430/522 |
| 4,312,941 | 1/1982 | Scharf et al. | 430/510 |
| 4,499,180 | 2/1985 | Hirai et al. | 430/559 |
| 4,511,650 | 4/1985 | Hirai et al. | 430/559 |
| 4,565,774 | 1/1986 | Kajiwara et al. | 430/382 |
| 4,581,323 | 4/1986 | Fisher et al. | 430/513 |
| 4,581,325 | 4/1986 | Kitchin et al. | 430/522 |
| 4,705,737 | 11/1987 | Hirai et al. | 430/203 |
| 4,731,321 | 3/1988 | Sato et al. | 430/559 |
| 5,135,842 | 8/1992 | Kitchin et al. | 430/510 |
| 5,258,274 | 11/1993 | Helland et al. | 430/522 |

FOREIGN PATENT DOCUMENTS 0377961 11/1989 European Pat. Off. .

*Primary Examiner*—Thorl Chea

*Attorney, Agent, or Firm*—Gary L. Griswold; Walter N. Kirn; Thomas C. Lagaly

[57] ABSTRACT

Certain poly(lactic acid) and poly(glycolic acid) polymers or copolymers, and certain carbonates, lactones, lactates, lactylates, lactides, glycolates, glycolylates, and glycolides have been found to stabilize thermal-dye-bleach constructions containing a dye in association with a thermally-generated-bleaching agent. Preferably, the thermally-generated-bleaching agent is a thermal-carbanion-generating agent such as a quaternary ammonium salt of a phenylsulfonylacetic acid or a thermal-nucleophile-generating agent such as an ammonium salt of a phenylsulfonylacetic acid. These materials have been found to be particularly effective when used in acutance and antihalation systems for photothermographic and photographic elements.

28 Claims, No Drawings

STABILIZED THERMAL-DYE-BLEACH CONSTRUCTIONS

BACKGROUND TO THE INVENTION

1. Field of the Invention

This invention relates to stabilized thermal-dye-bleach constructions and in particular, it relates to thermal-dye-bleach constructions containing poly(lactic acid) and poly(glycolic acid) polymers or copolymers, and certain carbonates, lactones, lactates, lactylates, lactides, glycolates, glycolylates, and glycolides as stabilizers, preferably for use in acutance and antihalation systems.

2. Background of the Art

Light-sensitive recording materials suffer from a phenomenon known as halation which causes degradation in the quality of the recorded image. Such degradation occurs when a fraction of the imaging light which strikes the photosensitive layer is not absorbed, but instead passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element may also cause light passing through the element to be scattered. Scattered light which is reflected from the film base will, on its second passage through the photosensitive layer, cause exposure over an area adjacent to the point of intended exposure. This effect leads to reduced image sharpness and image degradation. Silver-halide based photographic materials (including photothermographic materials) are prone to this form of image degradation since the photosensitive layers contain light-scattering particles (see, T. N. James, *The Theory of the Photographic Process,* 4th Edition, Chapter 20, MacMillan 1977).

In order to improve the image sharpness of photographic materials, it is customary to incorporate a dye in one or more layers of the material, the purpose of which is to absorb light that has been shattered within the coating and would otherwise lead to reduced image sharpness. To be effective, the absorption of this layer must be at the same wavelength as the sensitivity of the photosensitive layer.

In the case of imaging materials coated on a transparent base, a light-absorbing layer is frequently coated in a separate backing layer or underlayer on the reverse side of the substrate from the photosensitive layer. Such a coating, known as an "antihalation layer", effectively reduces reflection of any light which has passed through the photosensitive layer. A similar effect may be achieved by interposing a light-absorbing layer between the photosensitive layer and the substrate. This construction, known in the art as an "antihalation underlayer" is applicable to photosensitive coatings on non-transparent as well as on transparent substrates.

A light-absorbing substance may also be incorporated into the photosensitive layer itself in order to absorb scattered light. Substances used for this purpose are known as "acutance dyes." It is also possible to improve image quality by coating a light-absorbing layer above the photosensitive layer of a photographic element. Coatings of this kind, described in U.S. Pat. Nos. 4,312,941; 4,581,323; and 4,581,325; reduce multiple reflections of scattered light between the internal surfaces of a photographic element.

It is usually essential that coatings of antihalation or acutance dyes which absorb in the visible region of the spectrum should completely decolorize under the processing conditions of the photographic material concerned. This may be achieved by a variety of methods, such as by washing out or by chemical reaction in wet processing techniques, or by thermal bleaching during heat processing techniques. In the case of photothermographic materials which are processed by simply heating for a short period, usually between 100° C. and 200 ° C., antihalation or acutance dyes used must decolorize thermally.

Various thermal-dye-bleach systems are known in the art including single compounds which spontaneously decompose and decolorize at elevated temperatures and combinations of dye and thermal-dye-bleaching agent which together form a thermal-dye-bleach system.

European Patent Publication No. EP 0,377,961 A discloses the use of certain polymethine dyes for infrared antihalation in both wet-processed and dry-processed photographic materials. The dyes bleach completely during wet-processing, but remain unbleached after dry-processing. This is acceptable for some purposes because infrared dyes have a relatively small component of their absorption in the visible region. This absorption can be masked, for example, by using a blue-tinted polyester base. For most applications, however, it is preferable that the dyes bleach completely during dry-processing, leaving no residual stain.

Many substances are known which absorb visible and/or ultraviolet light, and many are suitable for image improvement purposes in conventional photographic elements sensitized to wavelengths below 650 nm. Triarylmethane and oxonol dyes, in particular, are used extensively in this connection. U.S. Pat. Nos. 3,609,360; 3,619,194; 3,627,527; 3,684,552; 3,852,093; 4,033,948; 4,088,497; 4,196,002; 4,197,131; 4,201,590; and 4,283,487 disclose various thermal-dye-bleach systems which absorb principally in the visible region of the electromagnetic spectrum and as such, are not readily adaptable for use as far-red or near-infrared absorbing constructions. No indication or examples are given of far-red or near-infrared absorbing thermal-dye-bleach systems.

U.S. Pat. Nos. 3,684,552, and 3,769,019 disclose the use of tetra-alkylammonium salts of cyanoacetic acid as bleaching agents for light- and heat-sensitive materials. These are unacceptable due to liberation of volatile, potentially toxic materials such as nitriles.

U.S. Pat. No. 5,135,842, incorporated herein by reference, describes thermal-dye-bleach constructions employing guanidinium salts of phenylsulfonylacetic acids and polymethine dyes such as IV and V (disclosed later herein). U.S. Pat. No. 5,258,274, incorporated herein by reference, also describes thermal-dye-bleach constructions employing guanidinium salts of phenylsulfonylacetic acids and styryl dyes. In both patents, upon heating, the guanidinium salts liberate guanidine which nucleophilically adds to the polymethine or styryl chain, respectively, thereby disrupting conjugation and decolorizing the dye. However, thermal-dye-bleach constructions employing guanidinium salts have relatively short shelf life, are subject to premature bleaching, and, upon heating, display slow bleaching over a broad temperature range.

Applicants' assignee's copending applications U.S. Ser. Nos. 07/993,642 and 07/993,650, both incorporated herein by reference, describe the use of quaternary ammonium salts of phenylsulfonacetic acids as bleaching agents for a wide variety of dyes. It is believed that upon heating, these quaternary-ammonium phenylsulfonylacetate salts decarboxylate to give carbon dioxide and a phenylsulfonylmethide anion. Addition of this anion to one of the double bonds of the dye chromophore results in effectively-irreversible disruption of conjugation in the dye and loss of color.

One problem that has been encountered with thermal-dye-bleach constructions containing materials capable of generating a nucleophile or carbanion upon thermolysis (i.e., a thermal-nucleophile-generating agent or thermal-carbanion-generating agent) is that the nucleophile or carbanion can be generated slowly during storage of the thermal-dye-bleach construction before use in an imaging process, thereby leading to premature bleaching of the dye and thus, poor image quality. Attempts to overcome this problem have included the addition of acids to the thermal-dye-bleach construction. However, acidic materials are slowly neutralized or decompose under conditions of storage, elevated temperature, and humidity. The neutralization or decomposition products thus formed no longer stabilize the thermal-dye-bleach layers, and thus, upon further aging, the dyes slowly bleach.

In order to find a solution to the above problem, research was conducted to find classes of materials which would 1) effectively stabilize thermal-dye-bleach constructions, thereby resulting in improved shelf life of the thermally bleachable materials, 2) not interfere or inhibit the effectiveness of the construction during imaging, and 3) allow rapid bleaching with heat.

SUMMARY OF THE INVENTION

It has now been found that certain polylactide and polyglycolide polymers or copolymers, carbonates, lactones, lactates, lactylates, lactides, glycolates, glycolylates, and glycolides effectively stabilize thermal-dye-bleach constructions. Thus, the present invention provides a thermal-dye-bleach construction comprising;

(a) a dye in association with a thermally-generated bleaching agent; and (b) at least one compound selected from the group consisting of:

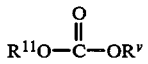

(i)

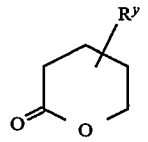

(ii)

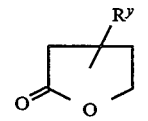

(iii)

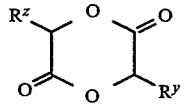

(vi)

-continued

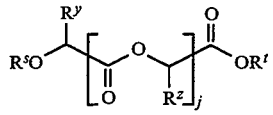

(v)

wherein:

$R^s$ is selected from hydrogen, alkyl, aralkyl, cycloalkyl, alkenyl and acyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^s$ are hydrogen, methyl, ethyl, and acetyl.

$R^t$ is selected from alkyl, aralkyl, cycloalkyl, and alkenyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^t$ are alkyl groups and, particularly, fluorinated alkyl groups. Polyethers and fluorinated ethers can also be used.

$R^u$ to $R^v$ are each independently selected from alkyl, aralkyl cycloalkyl, and alkenyl groups of up to 20 carbon atoms, preferably of up to 10 carbon atoms, and most preferably of up to 5 carbon atoms, and aryl groups of up to 14 carbon atoms, preferably up to 10 carbon atoms; with the proviso that only one of $R^u$ and $R^v$ may be alkyl. Preferred examples of $R^u$ to $R^v$ are aryl groups of up to 10 carbon atoms.

$R^y$ to $R^z$ are each independently selected from hydrogen, alkyl, aralkyl and alkenyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^y$ to $R^z$ are hydrogen, and alkyl groups of up to 5 carbon atoms.

j is an integer from 0 to 2,000.

The above compounds may serve as stabilizers for antihalation layers by minimizing prebleaching of the antihalation dyes. Similarly, the compounds may be used to stabilize acutance dye-bleach-systems. Mixtures of stabilizing compounds (i)-(v) are often useful and desirable in the constructions of the invention.

In principle, any thermally-generated bleaching agent can be used. Preferably, the thermally-generated bleaching agent is a thermal-nucleophile-generating agent or a thermal-carbanion-generating agent of general formula I:

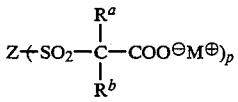

I wherein:

each of $R^a$ and $R^b$ are individually selected from: hydrogen, an alkyl group, an alkenyl group, a cycloalkyl group, an aralkyl group, an aryl group, and a heterocyclic group, and preferably, both $R^a$ and $R^b$ represent hydrogen;

p is one or two, and when p is one, Z is a monovalent group selected from: an alkyl group; a cycloalkyl group; an alkenyl group; and alkynyl group; an aralkyl group; an aryl group; and a heterocyclic group; and when p is two, Z is a divalent group selected from: an alkylene group; a cycloalkene group; an aralkylene group; arylene group; an alkynylene group; an alkenylene group, and a heterocyclic group; and, $M^+$ is a cation containing no labile hydrogen atoms or is a nucleophile-precursor.

In one aspect, $M^+$ is a cation which contains no labile hydrogen atoms so that it will not react with the carbanion generated from the thermal-carbanion-generating agent in such manner as to render the carbanion ineffective as a bleaching agent for the dye. In this instance, it is the carbanion itself which reacts with and bleaches the dye. In another aspect, $M^+$ is a nucleophile-precursor cation which contains at least one labile hydrogen atom and, therefore, will react with the carbanion generated from the anionic portion of the bleaching agent molecule in such a manner as to transform the cation $M^+$ into a nucleophile. In this case, it is the nucleophile generated from $M^+$, and not the carbanion, which bleaches the dye.

Preferably, $M^+$ is an organic cation. As used herein, the term "organic cation" means a cation whose sum total by weight of hydrogen and carbon atoms is greater than 50%, based upon the formula weight of the cation, halogen atoms being excluded from consideration.

The present invention also provides thermal-dye-bleach constructions in the form of photothermographic and photographic elements comprising: a support bearing an electromagnetic-radiation-sensitive photothermographic or photographic silver halide material; a thermally-generated-bleaching agent; a dye as an antihalation or acutance agent; and a stabilizer of the structure as disclosed above.

As is well understood in this area, substitution is not only tolerated, but is often advisable. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical substituent, the described chemical material includes the basic group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents bearing further substituents known in the art, such as hydroxyl, alkoxy, vinyl, phenyl, halogen atoms (F, Cl, Br, and I), cyano, nitro, amino, carboxyl, etc. On the other hand, the phrase "alkyl moiety" is limited to the inclusion of only pure open-chain and cyclic saturated hydrocarbon alkyl substituents, such as methyl, ethyl, propyl, t-butyl, cyclohexyl, adamantyl, octadecyl, and the like.

Other aspects, advantages, and benefits of the present invention are apparent from the detailed description, the examples, and the claims.

DETAILED DESCRIPTION OF THE INVENTION

The Stabilizer

Thermal bleaching materials are an important component in the construction of photothermographic, photographic, and thermal imaging elements. In particular, thermal bleaching materials have found use in antihalation layers and acutance agents for photothermographic and photographic materials. The stabilizing compounds of this invention may serve as stabilizers for antihalation layers by minimizing prebleaching of antihalation dyes. Similarly, the compounds may be used to stabilize acutance agents.

The following compounds may be employed as stabilizers in the present invention:

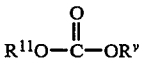
(i)

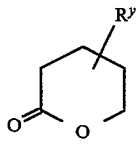
(ii)

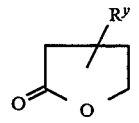
(iii)

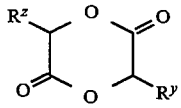
(vi)

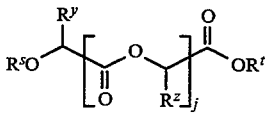
(v)

wherein:

$R^s$ is selected from hydrogen, alkyl, aralkyl, cycloalkyl, alkenyl and acyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^s$ are hydrogen, methyl, ethyl, and acetyl.

$R^t$ is selected from alkyl, aralkyl, cycloalkyl, and alkenyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^t$ are alkyl groups and, particularly, fluorinated alkyl groups. Polyethers and fluorinated ethers can also be used.

$R^u$ to $R^v$ are each independently selected from alkyl, aralkyl, cycloalkyl, and alkenyl groups of up to 20 carbon atoms, preferably of up to 10 carbon atoms, and most preferably of up to 5 carbon atoms, and aryl groups of up to 14 carbon atoms, preferably up to 10 carbon atoms; with the proviso that only one of $R^u$ and $R^v$ may be alkyl. Preferred examples of $R^u$ to $R^v$ are aryl groups of up to 10 carbon atoms such as phenyl and naphthyl.

$R^y$ to $R^z$ are each independently selected from hydrogen, alkyl, aralkyl, and alkenyl groups of up to 20 carbon atoms, preferably of up to 10 carbon atoms, and most preferably of up to 5 carbon atoms and aryl groups of up to 14 carbon atoms, preferably up to 10 carbon atoms. Preferred examples of $R^y$ to $R^z$ are hydrogen, and alkyl groups of up to 5 carbon atoms.

j is an integer from 0 to 2,000.

Compound (i) is an example of a carbonate. Compounds (ii)–(v) are derivatives of hydroxycarboxylic acid esters and are preferred for use in the invention. Compounds (ii) and (iii) are examples of 5- and 6-membered ring lactones, respectively. Compound (iv) is an example of a compound known as a glycolide ($R^y$, $R^z$=H) or a lactide ($R^y$, $R^z$=$CH_3$). The compounds represented by formula (v) are derivatives of α-hydroxycarboxylic acid esters. When j=0, compound (v) is not a polymer, but can be a glycolate ($R^y$, $R^z$=H) or a lactate ($R^y$, $R^z$=$CH_3$). When j=1, the compound is a dimer and can be a glycolylate ($R^y$, $R^z$=H) or a lactylate ($R^y$, $R^z$=$CH_3$). When j is greater than 1, compound (v) can be a homopolymer or a copolymer depending on the nature of the independently variable groups $R^y$ and $R^z$ and the degree of polymerization: when $R^y$ and $R^z$ are hydrogen, the compound is a poly(glycolic acid); when $R^y$ and $R^z$ are methyl, the compound is a poly(lactic acid); and when $R^y$ and $R^z$ are hydrogen and methyl, the compound is a poly(lactic acid/glycolic acid) copolymer. In general, the compounds represented by formula (v) are most preferred for use in the present invention.

Although not wishing to be bound by theory, Applicants believe that under conditions of elevated temperature and humidity, the stabilizing compounds of this invention slowly hydrolyze to form acidic materials that continually stabilize the thermal-dye-bleach layer without inhibiting the thermal bleaching of the construction upon imaging and heat-processing. Thus, the stabilizing compounds of this invention may serve as stabilizers for antihalation layers by minimizing prebleaching of antihalation dyes. Similarly, the compounds may be used to stabilize acutance dye-bleach-systems.

The Thermally-Generated Bleaching Agent

A variety of thermally-generated bleaching agents may be used for the purposes of this invention. Preferably these are thermal-nucleophile generating agents or thermal-carbanion generating agents. In general, any precursor that effectively irreversibly generates a nucleophile or a carbanion upon heating can be used. Carbanion precursors formed by decarboxylation of an organic acid anion (carboxylate anion) upon heating are preferred. It is further preferred that the carbanion precursor undergo decarboxylation at elevated temperatures, preferably in the range of 95°–150° C. and more preferably in the range of 115°–135° C.

Examples of carboxylic acid anions having the abovementioned property include trichloroacetate, acetoacetate, malonate, cyanoacetate, and sulfonylacetate. It is also preferred that the carboxylate anion have a functional group that accelerates decarboxylation such as an aryl group or an arylene group.

The carboxylic acid anion is preferably a sulfonylacetate anion having formula I.

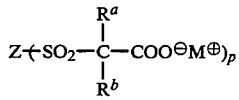

I

In formula I, each of $R^a$ and $R^b$ is a monovalent group such as hydrogen, an alkyl group, an alkenyl group, a cycloalkyl group, an aralkyl group, an aryl group, and a heterocyclic group. In addition, $R^a$ and/or $R^b$ taken together may represent non-metallic atoms necessary to form a 5-, 6-, or 7-membered ring. Hydrogen is preferred. Each of the monovalent groups may have one or more substituent groups. Each of the alkyl and alkenyl groups preferably has from one to eight carbon atoms.

$M^+$ is a cation containing no labile hydrogen atoms or is a nucleophile-precursor.

When $M^+$ contains no labile hydrogen atoms, it will not react with the carbanion generated by decomposition of the thermal-carbanion-generating agent in such manner as to render the carbanion ineffective as a bleaching agent for the dye. Thus $M^+$ may be a quaternary-ammonium cation wherein the central atom is attached only to carbon atoms, lithium, sodium, or potassium. Compounds such as cryptands can be used to increase the solubility of the carbanion generator when $M^+$ is a metal cation. Examples of these cations include tetra-alkylammonium cations and crown ether complexes of alkali metal cations. As used herein the term "quaternary-ammonium" further includes atoms that are in the same group in the periodic table as nitrogen. Such atoms include phosphorus, arsenic, antimony, and bismuth. Representative non-labile-hydrogen-containing cations $M^+$ are cations C1–C13 shown in Table I.

Alternatively, $M^+$ may be a nucleophile-precursor In this instance, $M^+$ is a cation which contains at least one labile hydrogen atom and which will react with the carbanion generated from the anionic portion of the bleaching agent molecule in such a manner as to transform $M^+$ into a nucleophile. Thus, when $M^+$ is a nucleophile-precursor, a wide variety of thermal-nucleophile-generating agents may be used, but a preferred embodiment uses a thermal-amine-generating agent, for example an ammonium or guanidinium salt. Preferably the amine should be a primary or a secondary amine. Compounds of this type are disclosed, for example, in U.S. Pat. Nos. 3,220,846; 4,060,420; 4,705,737; and 4,731,321; all incorporated herein by reference. Japanese Patent Application No.1-150,575 discloses bisamines as nucleophile precursors. Other nucleophile-precursors which generate amines include 2-carboxycarboxamide derivatives disclosed in U.S. Pat. No. 4,088,469; hydroxime carbamates disclosed in U.S. Pat. No. 4,511,650; and aldoxime carbamates disclosed in U.S. Pat. No. 4,499,180. The above nucleophile-generating agents are further described in U.S. Pat. No. 5,135,842, incorporated herein by reference. Representative labile-hydrogen-containing nucleophile-precursor cations $M^+$ are cations C14–C22 shown in Table I.

In formula I, p is one or two. When p is one, Z is a monovalent group such as an alkyl group, a cycloalkyl group, an alkenyl group, an alkynyl group, an aralkyl group, an aryl group, and a heterocyclic group. An aryl group is preferred. Each of the monovalent groups may have one or more substituent groups. The more preferred substituent groups are those having a Hammett sigma (para) value equal to or more positive than that of hydrogen (defined as zero).

When p is two, Z is a divalent group such as an alkylene group, an arylene group, a cycloalkylene group, an alkynylene group, an alkenylene group, an aralkylene group, and a heterocyclic group. Each of the divalent groups may have one or more substituent groups, an arylene group and a heterocyclic group being preferred. An arylene group is particularly preferred.

Examples of preferred phenylsulfonylcarboxylic acids are disclosed in the above-mentioned U.S. Pat. No. 4,981,965, the disclosure of which is incorporated herein by reference.

A preferred embodiment uses, as the thermal-nucleophile or thermal-carbanion generating agent, a quaternary-ammonium salt of an organic acid which decarboxylates upon heating to yield a carbanion. Preferably, the carboxylic acid anion is a phenylsulfonylacetate and bleaching of the antihalation layer is efficiently accomplished using thermal-carbanion-generating compounds of formula II.

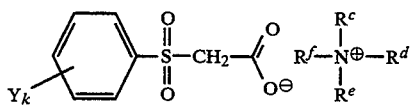

II wherein:

$R^c$ to $R^f$ are individually $C_1$ to $C_{18}$ alkyl, alkenyl, aralkyl, or aryl groups with the proviso that the total sum of carbon atoms contained in $R^c+R^d+R^e+R^f$ will not exceed 22, more preferably 15, and most preferably 10;

Y is a carbanion-stabilizing group; and k is 0–5.

In general Y may be any carbanion-stabilizing group. Preferred groups are those having a Hammett sigma (para) value $\sigma_p \geqq 0$. Such groups are exemplified by, but not limited to, hydrogen, nitro, chloro, cyano, perfluoroalkyl (e.g., trifluoromethyl), sulfonyl (e.g., benzenesulfonyl and methanesulfonyl), perfluoroalkylsulfonyl (e.g., trifluoromethanesulfonyl), and the like. The more preferred Y are those having Hammett $\sigma_p+0.5$, examples being methanesulfonyl and perfluoroalkyl. The most preferred embodiments are those that employ quaternary-ammonium salts of 4-nitro-phenylsulfonylacetic acid. For a discussion of Hammett $\sigma_p$ parameters, see M. Charton, "Linear Free Energy Relationships" *Chemtech* 1974, 502–511 and *Chemtech* 1975, 245–255.

Although not wishing to be bound by theory, it is believed that upon heating, the quaternary-ammonium phenylsulfonylacetate salt decarboxylates to give carbon dioxide and a phenylsulfonylmethide anion. Addition of this stabilized anion to one of the double bonds of the dye chromophore results in effectively-irreversible disruption of conjugation in the dye and loss of color. Thus, bleaching results from addition of a carbanion derived from the anionic portion of the bleaching agent. It is also contemplated that further carbanions, etc., capable of bleaching these dyes may be formed from neutral species present in, or added to, the system; such further bleaching agents might result from interaction of these species with the primary carbanion.

Thermal-nucleophile-generating bleaching agents, such as the thermal-amine-generating agents described in U.S. Pat. No. 5,135,842, are believed to function by a different mechanism. Those bleaching agents contain a labile-hydrogen-containing cation, such as cations C14–C22 in Table I, and are derived from primary and secondary amine salts of a phenylsulfonylacetic acid. Heating of those materials results similarly in decarboxylation to give carbon dioxide and a phenylsulfonylmethide anion; however, in those materials, the anion abstracts a labile proton from the positively charged primary or secondary amine salt to form a phenylsulfonylmethane and release an amine. Addition of that amine to one of the double bonds of the dye chromophore results in disruption of conjugation in the dye and thus, loss of color. Thus, bleaching results from addition of a nucleophile derived from the cationic portion of the bleaching agent; such addition may often be reversed by exposure to an acid.

Representative thermal-nucleophile-generating or thermal-carbanion-generating agents are shown in Table I. Representative cations are designated C1–C22 and representative anions are designated A1–A7. In general, any combination of anion with cation will be effective in these constructions.

Acid Addition

Although addition of the above-disclosed stabilizers of the present invention is critical, additional use of other acids in the thermal-dye-bleach solution is frequently beneficial. Acid retards pre-bleaching of the dye prior to coating, during coating, and in the drying ovens; and it results in longer solution pot life, higher $D_{max}$ and improved shelf life of the thermally bleachable coatings. The acid may be added to the polymer solution directly. Preferably, the acid is a carboxylic acid or a phenylsulfonylacetic acid. Phenylsulfonylacetic acids having strongly electron withdrawing groups on the phenyl ring are particularly preferred. Representative acids are acids corresponding to acidification (i.e., protonation) of anions A1–A7. In practice, use of the free acid of the anion used in the thermal-carbanion-generating salt is convenient.

The molar ratio of acid to nucleophile or carbanion generator is not thought to be unduly critical, but usually an excess of acid is used. A mole ratio between about 1/1 to about 5/1 is preferred.

The molar ratio of acid to dye is also not thought to be particularly critical, but usually an excess of acid is present. A ratio from about 1/1 to about 4/1 is preferred.

The stabilizers of this invention are usually present in excess by weight as compared to the weight of the thermal-dye-bleach agents and the dye. A ratio of from about 5:1 to about 50:1 by weight is preferred. A ratio of from about 5:1 to 20:1 is more preferred.

The molar ratio of thermal-(nucleophile or carbanion)-generator to dye is not thought to be particularly critical. If used alone, it is important that the molar amount of carbanion-generator be greater than that of the dye. A ratio from about 2/1 to about 5/1 is preferred. When used in conjunction with an amine-releaser, a ratio of less than 1/1 may be used as long as the total molar ratio of combined bleaching agents to dye is greater than 1/1.

In some cases, an isolable complex, III below, of a quaternary-ammonium phenylsulfonylacetate and a phenylsulfonylacetic acid may be prepared and utilized. The thermal-carbanion-generating agents described by III can be prepared readily by reacting in solution one mole of quaternary ammonium hydroxide with two moles of carboxylic acid or by treating a solution of the (one-to-one) quaternary ammonium salt with a second equivalent of acid. These "acid-salts" are often stable crystalline solids which are easily isolated and purified. When these compounds are heated they decarboxylate to generate an organic base in the form of a carbanion. By varying the structure of $R^c$ to $R^f$ as well as by varying the substituent groups on the phenyl ring, a variety of salts may be obtained. Thus, it is possible to modify the solubility and reactivity characteristics of the thermal-carbanion-generator salt.

III

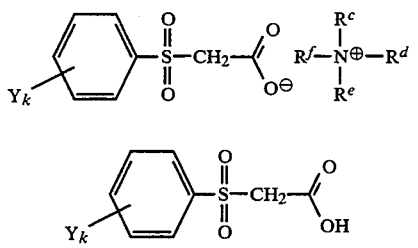

wherein $R^c$ to $R^f$Y and k are as defined earlier herein.

Use of Combinations of Bleaching Agents

Thermal-dye-bleach constructions employing mixtures of thermal-carbanion-generating or thermal-nucleophile-generating agents of the invention, such as those described in Table I, can also be used. Such mixtures maintain the improved shelf life and rapid bleaching over a narrow temperature range characteristic of the thermal-carbanion-generating agents. In addition, the combination of thermal-carbanion-generating agent with an amine salt has improved stability when compared with thermal-dye-bleach constructions containing only amine salts as the thermal-dye-bleach agent.

The Dye

The combination of the stabilizers of this invention with a dye and bleaching agent capable of generating a nucleophile or a carbanion upon thermolysis, e.g., a thermal-nucleophile-generating agent or a thermal-carbanion-generating agent, finds particular utility as antihalation or acutance constructions in photothermographic materials, e.g., dry silver materials, since the dyes will readily bleach during the thermal processing of the materials. In principle, the dye may be any dye capable of being bleached by the bleaching agent contained in the construction. Representative, non limiting classes of dyes include; polymethine dyes, auramine dyes, tricyanovinyl dyes, disulfone dyes, and styryl dyes.

Polymethine Dyes

A preferred class of dyes are polymethine dyes. These are disclosed, for example, in W. S. Tuemmler and B. S. Wildi, *J. Amer. Chem. Soc.* 1958, 80, 3772; H. Lorenz and R. Wizinger, *Helv. Chem. Acta.* 1945, 28, 600; U.S. Pat. Nos. 2,813,802, 2,992,938, 3,099,630, 3,275,442, 3,436,353 and 4,547,444; and Japanese Patent No. 56-109,358. The dyes have found utility in infrared screening compounds, as photochromic materials, as sensitizers for photoconductors, and as infrared absorbers for optical data storage media. Polymethine dyes have been shown to bleach in conventional photographic processing solutions, as disclosed in European Patent Publication No. EP 0,377,961. As noted above, U.S. Pat. No. 5,135,842 describes the use of polymethine dyes in thermal dye bleach constructions. The present invention provides a thermal-dye-bleach construction comprising a polymethine dye having a nucleus of general formula IV:

IV

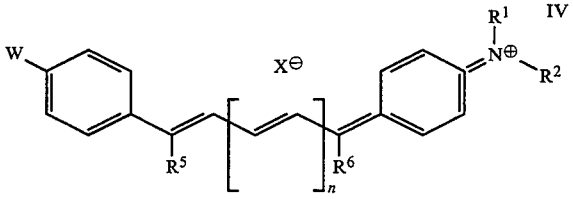

wherein:

n is 0, 1, 2, or 3;

W is selected from: hydrogen, alkyl groups of up to 10 carbon atoms, alkoxy and alkylthio groups of up to 10 carbon atoms, aryloxy and arylthio groups of up to 10 carbon atoms, $NR^1R^2$, and $NR^3R^4$;

$R^1$ to $R^4$ are each independently selected from: alkyl groups of up to 20 carbon atoms, alkenyl groups of up to 20 carbon atoms, and aryl groups of up to 14 carbon atoms; or $R^1$ and $R^2$ together and/or $R^3$ and $R^4$ together may represent the necessary atoms to complete a 5-, 6-, or 7-membered heterocyclic ring group; or one or more of $R^1$ to $R^4$ may represent the atoms necessary to complete a 5- or 6-membered heterocyclic ring group fused to the phenyl ring on which the $NR^1R^2$ or $NR^3R^4$ group is attached;

$R^5$ and $R^6$ are each independently selected from the group consisting of hydrogen atoms, alkyl groups of up to 20 carbon atoms, aryl groups of up to 20 carbon atoms, heterocyclic ring groups comprising up to 6 ring atoms, carbocyclic ring groups comprising up to 6 ring carbon atoms, and fused ring and bridging groups comprising up to 14 ring atoms; and $X^-$ is an anion.

The use of polymethine dyes, which may be a far-red- or near-infrared-absorbing dye, are particularly preferred.

Auramine Dyes

A second class of dyes is that of ketone imine dyes such as auramine dyes. Auramine dyes are derivatives of diarylmethanes and are prepared by the reaction of diarylketones such as Michler's Ketone, bis(4,4'-dimethylamino)benzophenone, with ammonium chloride in the presence of zinc chloride. Auramine dyes are commercially available.

Tricyanovinyl Dyes

A third class of dyes is that of tricyanovinyl dyes. These can be prepared by the reaction of tetracyanoethylene (TCNE) with tertiary aromatic amines having a free hydrogen para to the amine group. Detailed procedures for the preparation of tricyanovinyl dyes are given in B. C. McKusick, et al *J. Amer. Chem. Soc.* 1958, 80, 2806.

Disulfone Dyes

Another class of dyes is that of disulfone dyes. Disulfone dyes and processes for preparing these materials are disclosed, for example, in U.S. Pat. Nos. 3,932,526, 3,933,914, 3,984,357, 4,018,810, 4,069,233, 4,156,696, 4,357,405, and in copending U.S. patent application Ser. No. 07/730,225. The disclosures of these patents are incorporated herein by reference. The Disulfone dyes have found utility as catalysts, dyes, sensitizers, and non-linear optical materials.

Styryl Dyes

Another class of dyes is that of styryl dyes. Styryl dyes such as those described herein are prepared by the reaction of aromatic aldehydes with heterocyclic bases having an activated methylene group such as Fischer's Base (1,3,3-trimethyl-2-methylene indolenine). For a discussion of styryl dyes see F. M. Hamer, *The Cyanine Dyes and Related Compounds,* John Wiley & Sons, New York, 1964; Chapter XIII, p 398–440.

Thermal Bleaching Constructions

The stabilizers of this invention, bleaching agent (such as those of structures I–III), and dye are usually coated together with an organic binder as a thin layer on a substrate. The heat-bleachable construction thus formed may be used as an antihalation coating for photothermography or photography, it may be used directly as a thermographic element, or it may be used as an acutance or filter dye. The type of photothermographic element used in the invention is not critical. Examples of suitable photothermographic elements include dry silver systems (see, for example U.S. Pat. Nos. 3,457,075 and 5,258,274, both incorporated herein by reference) and diazo systems.

When used as an acutance, antihalation, or filter dye, in photographic or photothermographic elements, it is preferred to incorporate dyes in an amount sufficient to provide an optical density of from 0.05 to 3.0 absorbance units at λmax of the dye. The coating weight of the dye is generally from 0.001 to 1 g/m$^2$, preferably 0.001 to 0.05 g/m$^2$. When used for antihalation purposes, the dye must be present in a layer separate from the light-sensitive layer(s). The antihalation layer(s) may be positioned either above and/or below the light-sensitive layer(s), and if the support is transparent, an antihalation layer may be positioned on the surface of the support opposite the light-sensitive layer(s). For acutance purposes, the dyes are incorporated within the light-sensitive layer(s). When used for filter purposes, the dyes are normally incorporated in a layer separate from and positioned above the light-sensitive layer(s).

A wide variety of polymers are suitable for use as the binder in the heat-bleachable construction. The activity of the thermal-dye-bleach layer may be adjusted by suitable choice of polymeric binder, and thermal-dye-bleach layers with a wide variety of decolorization temperatures may be prepared. In general, polymeric binders of lower glass transition temperatures ($T_g$) produce thermal-dye-bleach constructions with greater reactivity but less shelf stability.

TABLE I

Representative Thermally-Generated Bleaching-Agent Precursors

Representative Non-Labile-Hydrogen-Containing Cations

| | | | |
|---|---|---|---|
| C1 | Tetramethylammonium$^+$ | C8 | K-Dibenzo-18-Crown-6$^+$ |
| C2 | Tetraethylammonium$^+$ | C9 | K-18-Crown-6$^+$ |
| C3 | Tetrapropylammonium$^+$ | C10 | Tetraphenylphosphonium$^+$ |
| C4 | Tetrabutylammonium$^+$ | C11 | Tetraphenylarsonium$^+$ |
| C5 | Benzyltrimethyl-ammonium$^+$ | C12 | N-Dodecylpyridinium$^+$ |
| C6 | Li-12-Crown-4$^+$ | C13 | Dodecyltrimethyl-ammonium$^+$ |
| C7 | Na-15-Crown-5$^+$ | | |

Representative Labile-Hydrogen-Containing Cations

C14 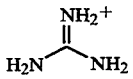

C19 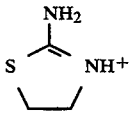

TABLE I-continued

Representative Thermally-Generated Bleaching-Agent Precursors

C15 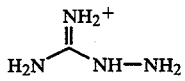

C20 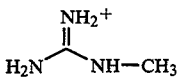

C16 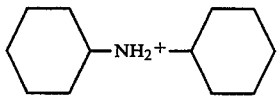

C21 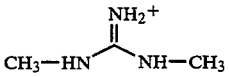

C17 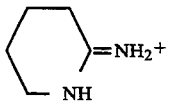

C22 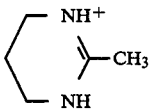

C18 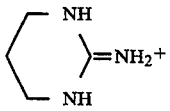

Representative Carbanion Precursors

A$^1$ 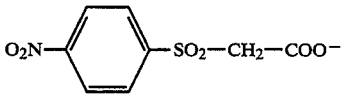

A$^2$ 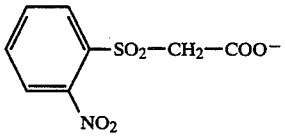

A$^3$ 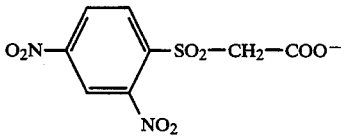

A$^4$ 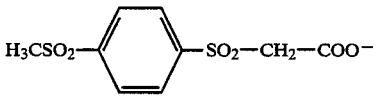

A$^5$ 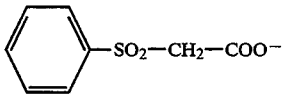

A$^6$ 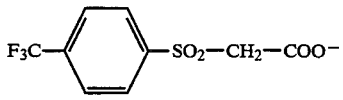

A$^7$ 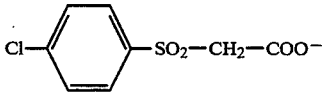

EXAMPLES

As the following examples show, according to the present invention there is defined a class of thermal-dye-bleach constructions comprising a stabilizer in association with a thermal bleaching agent and a dye.

Unless otherwise specified, all materials used in the following examples are readily available from standard commercial sources such as Aldrich Chemical Company, Milwaukee, Wis. or can be synthesized according to known procedures of synthetic organic chemistry.

Dye-1 is a polymethine dye that absorbs in the near infrared at 821 nm. It has a pale purple color due to a small amount of visible absorption and has the following structure:

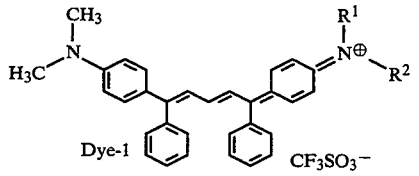

Preparation of Thermal Bleaching Agents, Example 1

Preparation of tetramethylammonium 4-nitrophenylsulfonylacetate (C1-A1)

Into a 100 ml flask equipped with magnetic stirrer were placed 2.45 g (0.01 mol) of 4-nitrophenylsulfonylacetic acid and 50 ml of acetone. Stirring was begun and upon dissolution of the acid, 4.0 g of a 25% methanolic solution (i.e., 1.00 g, 0.011 mol) of tetramethylammonium hydroxide was slowly added, dropwise over a 15 min period. A precipitate formed in the dark red solution. Filtration, washing with acetone (10 ml) and drying in air afforded 2.9 g (91%) of tetramethylammonium 4-nitrophenylsulfonylacetate (Compound C1-A1). $^1$H and $^{13}$C NMR were in agreement with the proposed structure.

Example 2

Preparation of other quaternary ammonium phenysulfonylacetates

In a manner similar to that above, the following quaternary ammonium 4-nitrophenylsulfonylacetates were prepared.

Tetraethylammonium 4-nitrophenylsulfonylacetate (Compound C2-A1)-from tetraethylammonium hydroxide and 4-nitrophenylsulfonylacetic acid.

Tetrabutylammonium 4-nitrophenylsulfonylacetate (Compound C4-A1)-from tetrabutylammonium hydroxide and 4-nitrophenylsulfonylacetic acid.

Tetramethylammonium 4-(trifluoromethyl)phenylsulfonylacetate (Compound C1-A6)-from tetramethylammonium hydroxide and 4-(trifluoromethyl)phenylsulfonylacetic acid.

Tetramethylammonium 4-chlorophenylsulfonylacetate (Compound C1-A7)-from tetramethylammonium hydroxide and 4-chlorophenylsulfonylacetic acid.

Additional quaternaryammonium phenylsulfonylacetates employing cations C1-C13 are prepared in a similar manner.

Example 3

Preparation of Guanidinium phenylsulfonylacetates

Guanidinium 4-methylphenylsulfonylacetate was prepared as follows: To a mixture of 4.441 g (0.0207 mol) of 4-methylphenylsulfonylacetic acid in 25 mL of ethanol was added 1.867 g (0.0104 mol) of guanidine carbonate and the mixture stirred at room temperature for 18 hr. The resultant product was then filtered off and air dried to afford 5.150 g; mp 152°–153° C. (dec). NMR was in agreement with the proposed structure. The 4-methylphenylsulfonylacetic acid was obtained from Lancaster Synthesis Inc. Windham, N. H.

Guanidinium phenylsulfonylacetate (Compound C14-A5) was prepared in an analagous manner from 2.310 g (0.01154 mol) of phenylsulfonylacetic acid and 1.039 g (0.005769 mol) of guanidine carbonate to afford 2.052 g of product; mp 137°–139° C. (dec). NMR was in agreement with the proposed structure.

Additional salts employing cations C14-C22 were prepared in a similar manner.

Example 4

Preparation of "Acid-Salts"

As noted above, "acid-salts" described by III can be readily prepared by treating one mole of quaternary-ammonium or other hydroxide with two moles of carboxylic acid or by treating a solution of neutral quaternary ammonium hydroxide or other salt with a second equivalent of acid. The materials are typically stable crystalline salts which are easy to isolate and purify. When these compounds are heated they decarboxylate and generate an organic carbanion.

Various salts have been obtained which exhibit a range of solubility. This gives them utility in a range of constructions and compatibility with various thermal-dye-bleach systems.

A solution of 24.5 g (0.10 mol) of 4-nitrophenylsulfonylacetic acid in 200 ml of acetone was prepared by stirring and filtration to remove some material that did not go into solution. To it was added 16.8 g of 25% tetramethylammonium hydroxide (i.e., 4.2 g, 0.046 mol) in methanol. Upon completion of the addition, the solution turned orange and a precipitate formed. Filtration, washing with 50 ml of methanol and 100 ml of acetone, and drying afforded 21.3 g (82%) of tetramethylammonium 4-nitrophenylsulfonylacetate/4-nitrophenylsulfonylacetic acid "acid-salt." Composition of the salts were confirmed using $^{13}$C NMR spectroscopy.

In a similar manner, other "acid-salts" were obtained. Reaction solvents were changed to accommodate solubility of the specific salt.

Preparation and Use of Heat-Bleachable Formulations

Typical heat-bleachable antihalation formulations were prepared as described below.

- Solution A: A solution of Eastman cellulose acetate butyrate (CAB 381-20), Goodyear polyester (PE-200), 2-butanone, toluene, or 4-methyl-2-pentanone was prepared.
- Solution B: When used, a solution of substituted-phenylsulfonylacetic acid in acetone or methanol was prepared.
- Solution C: A solution of polymethine dye of formula IV in acetone or methanol was prepared.
- Solution D: A solution of thermal carbanion generating salt or "acid-salt" in acetone, methanol, and/or dimethylformamide (DMF) was prepared.
- Solution E: When used, a solution of guanidinium thermal-nucleophile-generating agent in methanol or dimethylformamide (DMF) was prepared.

The resulting polymer, dye, and thermal-carbanion-generator, and amine-releaser solutions were combined and mixed thoroughly and coated onto a polyester substrate using a knife coater. The wet coating thickness was 3 mil (76 μm). The coating was dried 4 minutes at 180° F. (82° C). The substrate was either a clear or white opaque polyester. Absorbances were obtained using a Hitachi Model 110-A Spectrophotometer in either transmittance or reflectance mode.

The constructions were bleached by running them through a 3M Model 9014 Dry Silver Processor. The temperature was 260°–265° F. (127°–129° C.) and dwell time was 10 seconds.

Examples 5–9

For each of the Examples described below, solutions A through E were prepared (see Table V). To solution A, solution E was added followed by the stabilizer or solution of the stabilizer (see Table VI), then solutions B, C, and D, respectively. The solutions were then coated at 3.5 mils wet thickness onto PET film and dried at 180° F. for 4 minutes. The samples were processed in a 3M Model 9014 Dry Silver Processor.

TABLE V

| Solutions A through E Composition | Weight |
|---|---|
| Solution A | |
| Cellulose Acetate Butyrate (Kodak 381-20) | 0.525 g |
| Polyester Goodyear PE-200 | 0.0073 |
| 2-Butanone | 3.686 |
| Toluene | 1.792 |
| Solution B | |
| 4-Nitrophenylsulfonylacetic acid | 0.0310 |
| Acetone | 1.323 |
| Solution C | |
| Dye-1 | 0.0273 |
| Acetone | 1.927 |
| Solution D | |
| Tetramethylammonium 4-nitrophenylsulfonylacetate (Carbanion Generator C1-A1) 1:1 complex with 4-nitrophenyl-sulfonylacetic acid | 0.0113 |
| Methanol | 0.4810 |
| Solution E | |
| Guanidinium 4-nitrophenylsulfonylacetate (Compound C14-A1) | 0.0150 |
| Methanol | 0.6063 |
| Dimethylformamide | 0.6063 |

The structures of the stabilizers used is shown below. Compound 1 is diphenyl carbonate; Compound 2 is 3-benzyl-5-hydroxypentanoicacid lactone; Compound 3 is 4-n-hexyl-4-hydroxybutanoicacid lactone; and Compound 4 is 4-hydroxy-5-phenylbutanoic acid lactone. Compounds 1, 3, and 4 were obtained from Aldrich Chemical Company. Compound 2 was prepared by the procedure of A. J. Irwin et al. *J. Chem. Soc., Perkin I* 1978, 1636–1642. Compound 1 is an example of a carbonate, while compounds 2, 3, and 4 are examples of lactones.

1 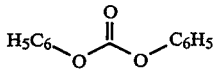

2 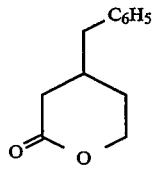

3 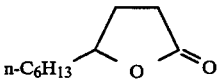

-continued

4 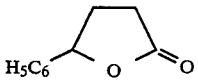

TABLE VI

| Example | Amounts of Stabilizers Used: Stabilizer | Stabilizer Amount | Acetone |
|---|---|---|---|
| 5A | 1 | 0.1895 g | 1.6435 g |
| 5B | 1 | 0.5685 | 4.931 |
| 6A | 2 | 0.1726 | 1.497 |
| 7A | 3 | 0.1506 | none |
| 7B | 3 | 0.4518 | none |
| 8A | 4 | 0.1435 | none |
| 8B | 4 | 0.4304 | none |
| 9 (control) | none | — | — |

The initial absorbance of each coating at 820 nm was measured as well as the final absorbance after passing the coated film through the thermal processor. The coatings were then stored at 70° F. at either 50% or 80% relative humidity for the specified times, and the remaining absorbance, and the absorbance after thermal processing, were measured. This data is shown in Table VII.

TABLE VII

| Example | Stabilizer Results: Initial Absorbance[1] | Aging Conditions[2] | Aged 1 month | Aged 2 months |
|---|---|---|---|---|
| 5A | 1.2 → 0.06 | 70/50 | 1.23 → 0.1 | 0.86 → 0.13 |
| 5B | 0.62 → 0.2 | 70/50 | 0.94 → 0.12 | 0.87 → 0.12 |
| 5B | 0.52 → 0.2 | 70/80 | 0.85 → 0.1 | 0.51 → 0.13 |
| 6A | 1.0 → 0.2 | 70/50 | 1.1 → 0.2 | 0.9 → 0.21 |
| 6A | 1.0 → 0.2 | 70/80 | 1.0 → 0.3 | 0.69 → 0.25 |
| 7A | 1.38 → 0.12 | 70/50 | 1.38 → 0.14 | 0.75 → 0.04 |
| 7A | 1.38 → 0.12 | 70/80 | 1.3 → 0.04 | 0.71 → 0.1 |
| 7B | 0.96 → 0.05 | 70/50 | 1.14 → 0.14 | 0.8 → 0.07 |
| 7B | 0.96 → 0.05 | 70/80 | 1.06 → 0.07 | 0.68 → 0.11 |
| 8A | 1.36 → 0.02 | 70/50 | 1.38 → 0.02 | 1.0 → 0.06 |
| 8A | 1.36 → 0.02 | 70/80 | 1.27 → 0.06 | 0.78 → 0.07 |
| 8B | 1.4 → 0.16 | 70/50 | 0.82 → 0.24 | 0.79 → 0.17 |
| 9A | 1.69 → 0.02 | 70/50 | 1.44 → 0.02 | 0.62 |
| 9A | 1.69 → 0.02 | 70/80 | 1.39 → 0.02 | 0.78 |

[1]Two figures separated by an arrow indicate the absorbance before and after thermal processing.
[2]70/50 indicates aging at 70° F. and 50% humidity.
[2]70/90 indicates aging at 70° F. and 80% humidity.

The amount of loss of dye absorbance is tabulated in a different manner in Table VIII. Here, the initial absorbance is used as a reference and the percentage change from that value is listed for the various aging conditions and times. The important comparison here is that a film without any stabilizer (Example 9) would have lost more than 55% of its initial absorbance after 2 months of aging. The films incorporating the stabilizers of the present invention retained more of the dye.

TABLE VIII

| Example | Percent Change in Absorbance with Aging: Aging Conditions | Aged 1 month | Aged 2 months |
|---|---|---|---|
| 5A | 70/50 | +3 | −28 |
| 5B | 70/50 | +51 | +40 |
| 5B | 70/80 | +37 | −18 |
| 6A | 70/50 | +10 | −10 |
| 6A | 70/80 | 0 | −31 |
| 7A | 70/50 | 0 | −46 |
| 7A | 70/80 | −6 | −49 |
| 7B | 70/50 | +19 | −17 |
| 7B | 70/80 | +10 | −29 |

TABLE VIII -continued

| Example | Aging Conditions | Aged 1 month | Aged 2 months |
|---|---|---|---|
| | Percent Change in Absorbance with Aging | | |
| 8A | 70/50 | +1 | −26 |
| 8A | 70/80 | −7 | −43 |
| 8B | 70/50 | −41 | −44 |
| 9A | 70/50 | −18 | −54 |
| 9A | 70/80 | −15 | −63 |

Examples 10–14

Examples 10–14 demonstrate use of poly (lactic acid/glycolic acid) copolymers as stabilizer for thermal dye bleach constructions. The poly (lactic acid/glycolic acid) polymer employed is designated Medisorb 8515-DL and was obtained from Medisorb Technologies International (a Stolle-DuPont Company), Wilmington, Del. It is a poly(lactic acid/glycolic acid) copolymer, has a molecular weight range of 40,000 to 100,000 and a Tg of 40°–45° C. It is an example of compound (v).

For each of the Examples described below, solutions A through E were prepared (see Table IX). Mixing was achieved by shaking in the case of small samples and by mechanical stirring in the case of larger samples. To solution A, solution E was added followed by the stabilizer or solution of the stabilizer (see Table VI), then solutions B, C, and D, respectively. The solutions were then coated at 3.5 mils wet thickness onto PET film and dried at 180° F. for 4 minutes. The samples were processed in a 3M Model 9014 Dry Silver Processor.

The resulting solutions were coated at 3 mils wet thickness and dried at 180 ° F. for 4 minutes. Samples of each coating were developed by passing them through a 3M Model 9014 Dry Silver processor and gave complete bleaching to a colorless film. The initial absorbance and aging data are shown in Table X.

TABLE X

| Example | Initial Absorbance | Final Absorbance | % Change |
|---|---|---|---|
| | Absorbance at 780 nm | | |
| 10 | 1.24 | 0.38 | 69.4 |
| 11 | 1.24 | 0.71 | 42.7 |
| 12 | 1.14 | 0.84 | 27.0 |
| 13 | 1.11 | 0.92 | 17.1 |
| 14 | 0.98 | 0.84 | 14.3 |

Final Absorbance is after 4 weeks at 80° F./80% relative humidity

The 70° F./50% RH aging did not show significant differences after 8 weeks to differentiate between the polylactide/glycolide and control material. Aging at 70° F./50% RH is less severe than aging for 4 weeks at 80° F./80% relative humidity.

TABLE IX

| Material | Ex. 10 | Ex. 11 | Ex. 12 | Ex. 13 | Ex. 14 |
|---|---|---|---|---|---|
| Solution A | | | | | |
| Cellulose Acetate-Butyrate (Kodak 381-20) | 0.525 g | 0.4725 g | 0.4200 g | 0.3150 g | 0.2100 g |
| Polyester Goodyear PE-200 | 0.0073 g | 0.0066 g | 0.0058 g | 0.0044 g | 0.0029 g |
| 2-Butanone | 3.686 g | 3.3174 g | 2.9488 g | 2.2116 g | 1.4744 g |
| Toluene | 1.792 g | 1.6128 g | 1.4336 g | 1.0752 g | 0.7168 g |
| Solution B | | | | | |
| 4-nitrophenyl-sulfonylacetic acid | 0.0310 g | 0.0310 g | 0.0310 g | 0.0310 g | 0.0310 g |
| Acetone | 1.323 g | 1.323 g | 1.323 g | 1.323 g | 1.323 g |
| Solution C | | | | | |
| Dye-1 | 0.0273 g | 0.0273 g | 0.0273 g | 0.0273 g | 0.0273 g |
| Acetone | 1.927 g | 1.927 g | 1.927 g | 1.927 g | 1.927 g |
| Solution D | | | | | |
| Tetramethylammonium 4-nitrophenyl-sulfonyl acetate (Carbanion Generator C1-A1) | 0.0113 g | 0.0113 g | 0.0113 g | 0.0113 g | 0.0113 g |
| Methanol | 0.4810 g | 0.4810 g | 0.4810 g | 0.4810 g | 0.4810 g |
| Solution E | | | | | |
| Guanidinium 4-nitrophenylsulfonylacetate (Compound C14-A1) | 0.0150 g | 0.0150 g | 0.0150 g | 0.0150 g | 0.0150 g |
| Methanol | 0.6063 g | 0.6063 g | 0.6063 g | 0.6063 g | 0.6063 g |
| Dimethylformamide | 0.6063 g | 0.6063 g | 0.6063 g | 0.6063 g | 0.6063 g |
| Solution F | | | | | |
| Medisorb 8515 DL | 0.000 g | 0.545 g | 0.1090 g | 0.2180 g | 0.3270 g |
| Acetone | 0.000 g | 0.5455 g | 1.0910 g | 2.1820 g | 3.2730 g |
| Methyl-2-pentanone | 0.600 g | 0.600 g | 0.600 g | 0.600 g | 0.600 g |
| wt % Medisorb 8515-DL | 0% | 10% | 20% | 40% | 60% |

Examples 15–18

The following Examples demonstrate the use of a lactide as a stabilizer for the thermal dye bleach constructions of the invention. Experiments 15–18 compare levels of L-Lactide to a control without stabilizer. L-Lactide is the L-form of the structure shown below and was obtained from Purac America, Lincolnshire, Ill.

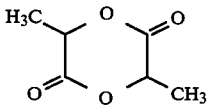

L-Lactide

TABLE XI

| Material | Ex. 15 | Ex. 16 | Ex. 17 | Ex. 18 |
|---|---|---|---|---|
| Solution A: | | | | |
| Kodak Cellulose Acetate Butyrate (CAB 381-20) | 0.525 g | 0.4200 g | 0.3675 g | 0.3150 g |
| Goodyear Polyester PE-200 | 0.0073 | 0.0058 | 0.0051 | 0.0044 |
| 2-Butanone | 3.686 | 2.9488 | 2.5802 | 2.2116 |
| Toluene | 1.792 | 1.4336 | 1.2544 | 1.0752 |
| 4-Methyl-2-pentanone | 0.600 | 0.600 | 0.600 | 0.600 |
| Solution B: | | | | |
| 4-nitrophenyl sulfonylacetic acid | 0.0248 | 0.0248 | 0.0248 | 0.0248 |
| Acetone | 2.0098 | 2.0098 | 2.0098 | 2.0098 |
| Solution C: | | | | |
| Dye-1 | 0.0273 | 0.0273 | 0.0273 | 0.0273 |
| Acetone | 1.927 | 1.927 | 1.927 | 1.927 |
| Solution D | | | | |
| Tetramethylammonium 4-nitrophenylsulfonylacetate | 0.0168 | 0.0168 | 0.0168 | 0.0168 |

TABLE XI-continued

| Material | Ex. 15 | Ex. 16 | Ex. 17 | Ex. 18 |
|---|---|---|---|---|
| (Carbanion Generator C1-A1) 1:1 complex with 4-nitro-phenyl-sulfonyl acetic acid | | | | |
| Methanol | 0.6781 | 0.6781 | 0.6781 | 0.6781 |
| Solution E | | | | |
| Guanidinium 4-nitrophenyl-sulfonylacetate (Compound C14-A1) | 0.0222 | 0.0222 | 0.0222 | 0.0222 |
| Methanol | 0.9023 | 0.9023 | 0.9023 | 0.9023 |
| Dimethylformamide | 0.9023 | 0.9023 | 0.9023 | 0.9023 |
| Solution F: | | | | |
| L-Lactide | 0.000 | 0.1090 | 0.1635 | 0.2180 |
| Acetone | 0.000 | 1.0900 | 1.6350 | 2.1800 |
| wt % solids of L-lactide | 0% | 20% | 30% | 40% |

Samples of unprocessed coatings were placed in constant temperature/humidity rooms maintained at 70° F./50% RH and at 70° F./80% RH and the absorbance of samples after various periods of time was measured. The absorbance data, shown below in Tables XII and XIII, demonstrates that thermal dye bleach constructions incorporating a lactide undergo less fade upon aging. The absorbances of the coatings were measured at 780 nm.

TABLE XII

| | Samples Aged at 70° F./50% RH | | | |
|---|---|---|---|---|
| Time | Ex. 15 | Ex. 16 | Ex. 17 | Ex. 18 |
| Initial | 1.40 | 1.32 | 1.04 | 1.20 |
| 28 Days | 1.40 | 1.32 | 1.04 | 1.20 |
| 112 Days | 0.12 | 1.09 | 1.09 | 1.02 |
| 168 Days | 0.00 | 0.73 | 0.91 | 0.93 |
| 217 Days | 0.00 | 0.54 | 0.61 | 0.68 |

TABLE XIII

| | Samples Aged at 70° F./80% RH | | | |
|---|---|---|---|---|
| Time | Ex. 15 | Ex. 16 | Ex. 17 | Ex. 18 |
| Initial | 1.40 | 1.32 | 1.04 | 1.20 |
| 28 Days | 1.28 | 1.26 | 1.04 | 1.16 |
| 112 Days | 0.07 | 0.40 | 0.77 | 0.86 |

Examples 19–21

Examples 19–21 also demonstrates the use of L-Lactide as a stabilizer for thermal dye bleach constructions.

TABLE XIV

| Material | Ex. 19 | Ex. 20 | Ex. 21 |
|---|---|---|---|
| Solution A | | | |
| Cellulose Acetate Butyrate (Kodak CAB 381-20) | 0.525 g | 0.3675 g | 0.3150 g |
| Polyester Goodyear PE200 | 0.0073 | 0.0051 | 0.0044 |
| 2-Butanone | 3.686 | 2.5802 | 2.2116 |
| Toluene | 1.792 | 1.2544 | 1.0752 |
| Solution B | | | |
| 4-nitrophenylsulfonylacetic acid | 0.0248 | 0.0248 | 0.0248 |
| Acetone | 2.0098 | 2.0098 | 2.0098 |
| Solution C | | | |
| Dye-1 | 0.0273 | 0.0273 | 0.0273 |
| Acetone | 1.927 | 1.927 | 1.927 |
| Solution D | | | |
| Tetramethylammonium 4-nitrophenyl-sulfonylacetate (Carbanion Generator (C1-A1) | 0.0168 | 0.0168 | 0.0168 |
| Methanol | 0.6781 | 0.0168 | 0.0168 |
| Solution E | | | |

TABLE XIV-continued

| Material | Ex. 19 | Ex. 20 | Ex. 21 |
|---|---|---|---|
| Guanidinium 4-nitrophenylsulfonylacetate (Compound C14-A1) | 0.0222 | 0.0222 | 0.0222 |
| Methanol | 0.9023 | 0.9023 | 0.9023 |
| DMF | 0.9023 | 0.9023 | 0.9023 |
| Solution F | | | |
| L-Lactide | 0.0 | 0.1635 | 0.2180 |
| Acetone | 0.0 | 1.6350 | 2.1800 |
| wt % solids of L-lactide | 0% | 30% | 40% |

The solution of each Example was then coated onto a poly(ethylene terephthalate) film at 3.5 mil (89 μm) wet thickness and dried 180° F. (82° C.) for 4 minutes. The samples were processed in a 3M Model 9014 Dry Silver Thermal Processor at 260° F. (127° C.) for 10 seconds. All samples completely bleached.

Samples of unprocessed coatings were placed in constant temperature/humidity rooms maintained at 70° F./50% RH and at 70° F./80% RH the absorbance of samples after various periods of time was measured. The absorbance data, shown below in Tables XV and Table XVI, demonstrates that thermal dye bleach constructions incorporating a lactide undergo less fade upon aging.

The absorbances of the coatings were measured at 820 nm.

TABLE XV

| | Samples Aged 70° F./50% RH | | |
|---|---|---|---|
| Time | Ex. 19 | Ex. 20 | Ex. 21 |
| Initial | 1.45 | 1.14 | 1.16 |
| 16 weeks | 0.10 | 0.97 | 1.14 |

TABLE XVI

| | Samples Aged at 70° F./80% RH | | |
|---|---|---|---|
| Time | Ex. 19 | Ex. 20 | Ex. 21 |
| Initial | 1.45 | 1.14 | 1.16 |
| 16 weeks | 0.07 | 0.83 | 0.68 |

Examples 22–24

Examples 22–24 demonstrate the use of a Glycolide-S as a stabilizer for the thermal dye bleach constructions of the invention and compare levels of Glycolide-S to a control without stabilizers. Glycolide-S has the structure shown below and was obtained from Henley Chemical Co, Newark, N.J.

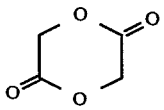

Glycolide-S

TABLE XVII

| Material | Ex. 22 | Ex. 23 | Ex. 24 |
|---|---|---|---|
| Solution A | | | |
| Cellulose Acetate Butyrate (Kodak CAB 381-20) | 0.525 g | 0.3675 g | 0.3150 g |
| Polyester Goodyear PE200 | 0.0073 | 0.0051 | 0.0044 |
| 2-Butanone | 3.686 | 2.5802 | 2.2116 |
| Toluene | 1.792 | 1.2544 | 1.0752 |
| Solution B | | | |
| 4-nitrophenylsulfonylacetic acid | 0.0248 | 0.0248 | 0.0248 |
| Acetone | 2.0098 | 2.0098 | 2.0098 |

TABLE XVII-continued

| Material | Ex. 22 | Ex. 23 | Ex. 24 |
|---|---|---|---|
| Solution C | | | |
| Dye-1 | 0.0273 | 0.0273 | 0.0273 |
| Acetone | 1.927 | 1.927 | 1.927 |
| Solution D | | | |
| Tetramethylammonium 4-nitrophenylsulfonylacetate (Carbanion Generator C1-A1) | 0.0168 | 0.0168 | 0.0168 |
| Methanol | 0.6781 | 0.0168 | 0.0168 |
| Solution E | | | |
| Guanidinium 4-nitrophenylsulfonyl-acetate (Compound C14-A1) | 0.0222 | 0.0222 | 0.0222 |
| Methanol | 0.9023 | 0.9023 | 0.9023 |
| DMF | 0.9023 | 0.9023 | 0.9023 |
| Solution F | | | |
| Glycolide S | 0.0 | 0.1635 | 0.2180 |
| Acetone | 0.0 | 1.6350 | 2.1800 |
| wt % solids of Glycolide-S | 0% | 30% | 40% |

The solution of each Example was then coated onto a poly(ethylene terephthalate) film at 3.5 mil (89 μm) wet thickness and dried 180° F. (82° C.) for 4 minutes. The samples were processed in a 3M Model 9014 Dry Silver Thermal Processor at 260° F. (127° C.) for 10 seconds. All samples completely bleached.

Samples of unprocessed coatings were placed in constant temperature/humidity rooms maintained at 70° F./50% RH and at 70° F./80% RH. The absorbance of samples after various periods of time was measured. The absorbance data, shown below in Tables XVIII and XIX, demonstrates that thermal dye bleach constructions incorporating a lactide undergo less fade upon aging. The absorbances of the coatings were measured at 820 nm.

TABLE XVIII

| | Samples Aged at 70° F./50% RH | | |
|---|---|---|---|
| Time | Ex. 22 | Ex. 23 | Ex. 24 |
| Initial | 1.45 | 0.96 | 0.95 |
| 16 weeks | 0.10 | 0.85 | 0.80 |

TABLE XIX

| | Samples Aged at 70° F./80% RH | | |
|---|---|---|---|
| Time | Ex. 22 | Ex. 23 | Ex. 24 |
| Initial | 1.45 | 0.96 | 0.95 |
| 16 weeks | 0.07 | 0.96 | 0.90 |

Examples 25–26

Examples 25–26 demonstrate the ability of lactate esters to stabilize thermal dye bleach constructions against bleaching. The lactate ester used was methyl lactate. Example 25 served as a control and contained no methyl lactate.

TABLE XX

| Material | Ex. 25 | Ex. 26 |
|---|---|---|
| Solution A: | | |
| Cellulose Acetate Butyrate Kodak CAB 381-20 | 1.0037 g | 1.0037 g |
| Goodyear Polyester PE 200 | 0.0014 | 0.0014 |
| 2-butanone | 6.9823 | 6.9823 |
| Solution B | | |
| 4-nitrophenyl-sulfonylacetic acid | 0.0237 | 0.0237 |
| Acetone | 0.9565 | 0.9565 |

TABLE XX-continued

| Material | Ex. 25 | Ex. 26 |
|---|---|---|
| Solution C | | |
| Dye-1 | 0.0273 | 0.0273 |
| Acetone | 0.6127 | 0.6127 |
| 4-methyl-2-pentanone | 0.2750 | 0.2750 |
| Solution D | | |
| Tetramethylammonium 4-chlorophenylsulfonylacetate (Carbanion Generator C1-A7) | 0.0092 | 0.0092 |
| Methanol | 0.2610 | 0.2610 |
| Solution E | | |
| Guanidinium 4-nitrophenylsulfonyl-acetate (Compound C14-A1) | 0.0227 | 0.0227 |
| Methanol | 0.9023 | 0.9023 |
| Dimethylformamide | 0.9023 | 0.9023 |
| Solution F | | |
| Methyl lactate | 0.0000 | 0.4932 (90% sol'n in MeOH) |
| Methanol | 0.0000 | |

The solutions were then coated onto a poly(ethylene terephthalate) film at 5 mil (127 μm) wet thickness and dried 180° F. (82° C.) for 4 minutes. The samples were processed in a 3M Model 9014 Dry Silver Thermal Processor at 250° F. (121° C.) for 15 seconds. All samples completely bleached.

Samples of unprocessed coatings were placed in a constant temperature/humidity rooms maintained at 70° F./50% RH and at 70° F./80% RH. The absorbance of samples after various periods of time was measured. The absorbance data, shown below, demonstrates that thermal dye bleach constructions incorporating a lactate ester undergo less fade upon aging. The absorbances of the coatings were measured at 820 nm.

TABLE XXI

| | Samples Aged at 70° F./50% RH | |
|---|---|---|
| Time | Ex. 25 | Ex. 26 |
| Initial Absorbance | 1.834 | 1.897 |
| 2 weeks | 1.681 | 1.897 |

TABLE XXII

| | Samples Aged at 70° F./80% RH | |
|---|---|---|
| Time | Ex. 25 | Ex. 26 |
| Initial Absorbance | 1.834 | 1.897 |
| 5 weeks | 0.746 | 1.256 |
| 13 weeks | 0.215 | 0.471 |

Example 27–29

Examples 27–29 compare an "end capped" poly(lactic acid) polymer with a control without any stabilizer. The poly(lactic acid) polymer, identified as Ac-$(PLA)_6$-OEt, has about 6 poly(lactic acid) groups 100% acetylated and 100% esterfied with -OEt groups and was prepared as described below.

Preparation of Ac-$(PLA)_6$-OEt

Lactic acid oligomers were prepared by heating 622.79 g of 85% lactic acid (obtained from Aldrich Chemical Co.) to 40° C. under a 30 torr vacuum for 18 hr. This material, with a typical average degree of polymerization of 6, was then mixed with 300 mL of acetic anhydride and heated at 120° C. for 6 hr. Much of the excess acetic anhydride was then removed by distillation under reduced pressure. After cooling to 60° C., a mixture of 75 mL of water in 425 mL of tetrahydrofuran was added and stirred for 50 min. The majority of the water and THF were removed by distillation under a 30 torr vacuum, followed by addition of 500 mL of ethyl acetate. The mixture was extracted twice with saturated brine solution, dried over anhydrous magnesium sulfate, filtered, and the solvent removed at reduced pressure. To 421 g of the resultant material dissolved in 1.1 L of THF was added 79.9 g of triethyl amine, followed by 81.6 g of ethyl chloroformate in 50 mL of THF dropwise over 45 min. with stirring. After an additional 45 min, 34.6 g of ethanol was added, the mixture heated to reflux for 2.5 hr, filtered, and most of the solvent removed under reduced pressure. Ethyl acetate was added, the solution washed twice with saturated brine solution, dried over anhydrous magnesium sulfate solution, filtered, and concentrated under reduced pressure to give the desired oligomeric lactic acid, capped with acetate on the alcohol chain ends and with ethyl ester groups on the carboxylic acid ends.

It is believed to have the following structure:

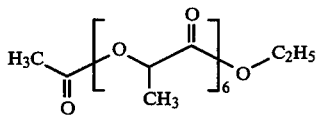

Ac—(PLA)$_6$—OEt

TABLE XXII

| Material | Ex. 27 | Ex. 28 | Ex. 29 |
|---|---|---|---|
| Solution A: | | | |
| Cellulose Acetate Butyrate Kodak CAB 381-20 | 1.0037 g | 1.0037 g | 1.0037 g |
| Goodyear Polyester PE 200 | 0.0014 | 0.0014 | 0.0014 |
| 2-butanone | 6.9823 | 6.9823 | 6.9823 |
| Solution B | | | |
| 4-nitrophenylsulfonylacetic acid | 0.0237 | 0.0237 | 0.0237 |
| Acetone | 0.9565 | 0.9565 | 0.9565 |
| Solution C | | | |
| Dye-1 | 0.0273 | 0.0273 | 0.0273 |
| Acetone | 0.6127 | 0.6127 | 0.6127 |
| 4-methyl-2-pentanone | 0.275 | 0.275 | 0.275 |
| Solution D | | | |
| Tetramethylammonium 4-chlorophenylsulfonylacetate (Carbanion Generator C1-A7) | 0.0092 | 0.0092 | 0.0092 |
| Methanol | 0.2610 | 0.2610 | 0.2610 |
| Solution E | | | |
| Guanidinium 4-nitrophenylsulfonylacetate (Compound C14-A1) | 0.0227 | 0.0227 | 0.0227 |
| Methanol | 0.9023 | 0.9023 | 0.9023 |
| Dimethylformamide | 0.9023 | 0.9023 | 0.9023 |
| Solution F | | | |
| Ac-(PLA)$_6$-OEt | 0.0000 | 0.4035 | 0.2017 |

The solutions were then coated onto a poly(ethylene terephthalate) film at 5 mil (127 μm) wet thickness and dried 180° F. (82° C.) for 3 minutes. The samples were processed in a 3M Model 9014 Dry Silver Thermal Processor at 250° F. (121° C.) for 15 seconds. All samples completely bleached.

Samples of unprocessed coatings also were placed in a constant temperature/humidity rooms maintained at 70° F./50% RH and at 70° F./80% RH. The absorbance of samples after various periods of time was measured. The absorbance data, shown below, demonstrates that thermal dye bleach constructions incorporating a lactide undergo less fade upon aging. The absorbances of the coatings were measured at 820 nm.

TABLE XXIV

| Samples Aged at 70° F./50% RH | | | |
|---|---|---|---|
| Experimental Points | Ex. 27 | Ex. 28 | Ex. 29 |
| Initial Absorbance | 2.04 | 1.895 | 1.957 |
| 3 weeks | 0.941 | 1.895 | 1.957 |
| 8 weeks | 0.200 | 1.618 | 1.672 |

TABLE XXIV

| Samples Aged at 70° F./80% RH | | | |
|---|---|---|---|
| Experimental Points | Ex. 27 | Ex. 28 | Ex. 29 |
| Initial Absorbance | 2.04 | 1.895 | 1.957 |
| 8 weeks | 0.205 | 1.543 | 1.539 |

Examples 30–32

In the following example, L-lactide was subjected to partial methanolysis by heating in methanol to form a mixture of 86.69% methyl lactylate, 8.45% L-lactide and 4.86% lactic acid.

TABLE XXIV

| Material | Ex. 30 | Ex. 31 | Ex. 32 |
|---|---|---|---|
| Solution A: | | | |
| Cellulose Acetate butyrate Kodak CAB 381-20 | 1.0037 | 1.0037 | 1.0037 |
| Gooldyear Polyester PE 200 | 0.0014 | 0.0014 | 0.0014 |
| 2-butanone | 6.9823 | 6.9823 | 6.9823 |
| Solution B: | | | |
| 4-nitrophenyl-sulfonylacetic acid | 0.0237 | 0.0237 | 0.0237 |
| Acetone | 0.9565 | 0.9565 | 0.9565 |
| Solution C: | | | |
| Dye-1 | 0.0273 | 0.0273 | 0.0273 |
| Acetone | 0.6127 | 0.6127 | 0.6127 |
| 4-methyl-2-pentanone | 0.275 | 0.275 | 0.275 |
| Solution D: | | | |
| Tetramethylammonium 4-chlorophenyl-sulfonylacetate (Carbanion Generator C1-A7) | 0.0092 | 0.0092 | 0.0092 |
| Methanol | 0.2610 | 0.2610 | 0.2610 |
| Solution E | | | |
| Guanidinium 4-nitrophenylsulfonyl-acetate (Compound C14-A1) | 0.0227 | 0.0227 | 0.0227 |
| Methanol | 0.9023 | 0.9023 | 0.9023 |
| Dimethylformamide | 0.9023 | 0.9023 | 0.9023 |
| Solution F | | | |
| Methyl lactylate | 0.000 | 0.542 | 0.651 |
| FC-171 Antistat | 0.014 | 0.014 | 0.014 |

*FC-171 is a fluorochemical antistat and was obtained from 3M Company St. Paul MN.

The solutions were coated onto poly(ethylene terephthalate) films at 5 mil (127 μm) wet thickness and dried 180° F. (82° C.) for 3 minutes. The samples were processed in a 3M Model 9014 Dry Silver Thermal Processor at 250° F. (121° C.) for 15 seconds. All samples completely bleached.

Samples of unprocessed coatings also were placed in a constant temperature/humidity rooms maintained at 70° F./50% RH and at 70° F./80% RH. The absorbance of samples after various periods of time was measured. The absorbance data, shown below, demonstrates that thermal dye bleach constructions incorporating lactide which had undergone partial methanolysis undergo less fade upon aging. The absorbances of the coatings were measured at 820 nm.

TABLE XXV

| Experimental Points | Samples Aged at 70° F./50% RH Ex. 30 | Ex. 31 | Ex. 32 |
|---|---|---|---|
| Initial | 2.04 | 1.86 | 1.86 |
| 2 weeks | 1.933 | 1.79 | 1.86 |
| 4 weeks | 0.691 | 1.076 | 1.33 |

TABLE XXVI

| Experimental Points | Samples Aged at 70° F./80% RH Ex. 30 | Ex. 31 | Ex. 32 |
|---|---|---|---|
| Initial | 2.04 | 1.86 | 1.86 |
| 2 weeks | 1.97 | 1.80 | 1.80 |
| 4 weeks | 1.08 | 1.55 | 1.58 |

Examples 33–35

Examples 33–35 demonstrate the ability of perfluorinated lactate esters to stabilize thermal dye bleach constructions against bleaching. Example 33 served as a control and contained no stabilizer material.

Preparation of Perfluorinated Lactate

A mixture of 2.88 g of L-Lactide, 28 g of 1H,1H,2H,2H-perfluorooctanol and 0.1 g of p-toluenesulfonic acid was heated to 140° C. for 40 min. To this was added 0.5 g of sodium carbonate powder and the mixture filtered. The excess alcohol was removed by vacuum distillation (pot temperature 95° C.) to afford 12.5 g of lactate product. The product is a liquid and was used without further purification. The perfluorinated lactate ester is believed to have the following structure:

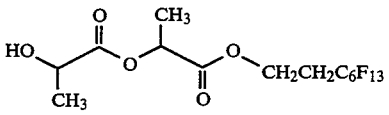

TABLE XXVII

| Material | Ex. 33 | Ex. 34 | Ex. 35 |
|---|---|---|---|
| Solution A: | | | |
| Cellulose Acetate Butyrate Kodak CAB 381-20 | 1.0037 g | 1.0037 g | 1.0037 g |
| Goodyear Polyester PE 200 | 0.0014 | 0.0014 | 0.0014 |
| 2-butanone | 6.9823 | 6.9823 | 6.9823 |
| Solution B | | | |
| 4-nitrophenyl-sulfonyl acetic acid | 0.0237 | 0.0237 | 0.0237 |
| Acetone | 0.9565 | 0.9565 | 0.9565 |
| Solution C | | | |
| Dye-1 | 0.0273 | 0.0273 | 0.0273 |
| Acetone | 0.6127 | 0.6127 | 0.6127 |
| 4-methyl-2-pentanone | 0.2750 | 0.2750 | 0.2750 |
| Solution D | | | |
| Tetramethylammonium 4-chlorophenylsulfonylacetate (Carbanion Generator C1-A7) | 0.0092 | 0.0092 | 0.0092 |
| Methanol | 0.2610 | 0.2610 | 0.2610 |
| Solution E | | | |
| Guanidinium 4-nitrophenylsulfonylacetate (Compound C14-A1) | 0.0227 | 0.0227 | 0.0227 |
| Methanol | 0.9023 | 0.9023 | 0.9023 |
| Dimethylformamide | 0.9023 | 0.9023 | 0.9023 |
| Solution F | | | |
| fluorinated lactate | 0.0000 | 0.05 | 0.10 |

The solutions were then coated onto a poly(ethylene terephthalate) film at 5 mil (127 μm) wet thickness and dried 180° F. (82° C.) for 4 minutes. The samples were processed in a 3M Model 9014 Dry Silver Thermal Processor at 250° F. (121° C.) for 15 seconds. All samples completely bleached.

Samples of unprocessed coatings were placed in a constant temperature/humidity rooms maintained at 70° F./50% RH and at 70° F./80% RH. The absorbance of samples after various periods of time was measured. The absorbance data, shown below, demonstrates that thermal dye bleach constructions incorporating a lactate ester undergo less fade upon aging. The absorbances of the coatings were measured at 820 nm.

TABLE XXVIII

| Time | Samples Aged at 70° F./50% RH Ex. 33 | Ex. 34 | Ex. 35 |
|---|---|---|---|
| Initial Absorbance | 2.038 | 2.115 | 2.150 |
| 4 weeks | 0.974 | 1.393 | 1.844 |

TABLE XXXIX

| Time | Samples Aged at 70° F./80% RH Ex. 33 | Ex. 34 | Ex. 35 |
|---|---|---|---|
| Initial Absorbance | 2.038 | 2.115 | 2.150 |
| 4 weeks | 1.107 | 1.207 | 1.681 |

Examples 36–37

The pale purple coating of Example 35 was evaluated as a potential thermographic medium. The coating prepared as described in Example 35 had a pale purple color. This coating was found to produce a pleasing negative clear-on-purple transparent copy from printed text when passed through a 3M Transparency Maker.

A construction similar to that of Example 35 but using a blue dye of structure IV ($W=CH_3O-$, $R^5=CH_3O-C_6H_5-$, $X^-$=perfluoroethylcyclohexanesulfonate), produced a pleasing negative clear-on-blue transparent copy from printed text when passed through a 3M Transparency Maker.

Reasonable modifications and variations are possible from the foregoing disclosure without departing from the spirit or scope of the present invention as defined in the claims.

What is claimed is:

1. A thermal-dye-bleach layer comprising:

(a) a thermal bleachable dye in association with a thermally-generated-bleaching agent; and (b) at least one compound selected from the group consisting of:

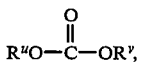

(i)

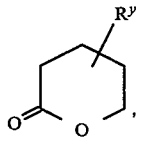

(ii)

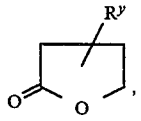

(iii)

-continued (iv)

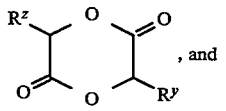

, and (v)

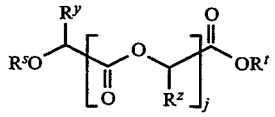

wherein:

$R^s$ is selected from alkyl, aralkyl, cycloalkyl, alkenyl and acyl groups of up to 20 carbon atoms, aryl groups of up to 14 carbon atoms, and hydrogen;

$R^t$ is selected from alkyl, aralkyl, cycloalkyl, and alkenyl groups of up to 20 carbon atoms, and aryl groups of up to 14 carbon atoms;

$R^u$ to $R^v$ are each independently selected from alkyl, aralkyl, cycloalkyl, and alkenyl groups of up to 20 carbon atoms, and aryl groups of up to 14 carbon atoms, with the proviso that only one of $R^u$ and $R^v$ may be alkyl;

$R^y$ to $R^z$ are each independently selected from alkyl, aralkyl, and alkenyl groups of up to 20 carbon atoms, aryl groups of up to 14 carbon atoms, and hydrogen; and j is an integer from 0 to 2,000.

2. The thermal-dye-bleach layer according to claim 1 wherein:

$R^s$ is selected from alkyl, aralkyl, cycloalkyl, alkenyl, acyl, and aryl groups of up to 10 carbon atoms, and hydrogen;

$R^t$ is selected from alkyl, aralkyl, cycloalkyl, alkenyl, and aryl groups of up to 10 carbon atoms;

$R^u$ to $R^v$ are each independently selected from alkyl, aralkyl cycloalkyl, alkenyl, and aryl groups of up to 10 carbon atoms; and $R^y$ to $R^z$ are each independently selected from alkyl, aralkyl, alkenyl, and aryl groups of up to 10 carbon atoms, and hydrogen.

3. The thermal-dye-bleach layer according to claim 2 wherein:

$R^s$ is selected from alkyl, aralkyl, cycloalkyl, alkenyl, and acyl groups of up to 5 carbon atoms, aryl groups of up to 6 carbon atoms, and hydrogen;

$R^t$ is selected from alkyl, aralkyl, cycloalkyl, and alkenyl groups of up to 5 carbon atoms, and aryl groups of up to 6 carbon atoms;

$R^u$ to $R^v$ are each independently selected from alkyl, aralkyl cycloalkyl, and alkenyl groups of up to 5 carbon atoms, and aryl groups of up to 6 carbon atoms; and $R^y$ to $R^z$ are each independently selected from alkyl, aralkyl, and alkenyl groups of up to 5 carbon atoms, aryl groups of up to 6 carbon atoms, and hydrogen.

4. The thermal-dye-bleach layer according to claim 1 wherein:

$R^s$ is selected from hydrogen, methyl, ethyl, and acetyl;

$R^t$ is a fluorinated alkyl group;

$R^u$ and $R^v$ are each independently aryl groups of up to 10 carbon atoms; and $R^y$ and $R^z$ are each independently selected from alkyl groups of up to 5 carbon atoms and hydrogen.

5. The thermal-dye-bleach layer according to claim 1 wherein said at least one compound is selected from the group consisting of poly(lactic acid) and poly(glycolic acid) polymers or copolymers, carbonates, lactones, lactates, lactylates, lactides, glycolates, glycolylates, and glycolides.

6. The thermal-dye-bleach layer according to claim 1 wherein said thermally-generated-bleaching agent is of the of general formula I:

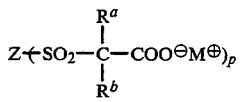

I wherein:

each of $R^a$ and $R^b$ are individually selected from: hydrogen, an alkyl group, an alkenyl group, a cycloalkyl group, an aralkyl group, an aryl group, and a heterocyclic group;

p is one or two, and when p is one, Z is a monovalent group selected from: an alkyl group, a cycloalkyl group, an alkenyl group, an alkynyl group, an aralkyl group, an aryl group, and a heterocyclic group, and when p is two, Z is a divalent group selected from: an alkylene group, an arylene group, a cycloalkylene group, an alkylnylene group, an aralkylene group, an alkenylene group, and a heterocyclic group; and $M^+$ is a cation.

7. The thermal-dye-bleach layer according to claim 1 wherein said thermally-generated-bleaching agent comprises a quaternary-ammonium salt of a phenylsulfonylacetic acid which liberates one or more carbanion groups upon thermal decomposition.

8. The thermal-dye-bleach layer according to claim 7 wherein said quaternary ammonium salt of a phenylsulfonylacetic acid is represented by the following formula:

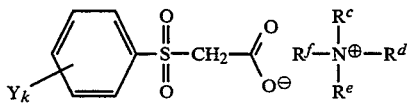

wherein:

Y represents a carbanion-stabilizing group;

k is 0–5; and $R^c$ to $R^f$ are individually $C_1$ to $C_{18}$ alkyl, alkenyl, aralkyl, or aryl group with the proviso that the total sum of carbon atoms contained in $R^c+R^d+R^e+R^f$ will not exceed 22.

9. The thermal-dye-bleach layer according to claim 6 wherein said thermally-generated-bleaching agent comprises a cation selected from the group consisting of C1 to C22 in combination with an anion selected from the group consisting of A1 to A7:

| | | | |
|---|---|---|---|
| C1 | Tetramethylammonium$^+$, | C8 | K-Dibenzo-18-Crown-6$^+$, |
| C2 | Tetraethylammonium$^+$, | C9 | K-18-Crown-6$^+$, |
| C3 | Tetrapropylammonium$^+$, | C10 | Tetraphenyl-phosphonium$^+$, |
| C4 | Tetrabutylammonium$^+$, | C11 | Tetraphenylarsonium$^+$, |
| C5 | Benzyltrimethyl-ammonium$^+$, | C12 | N-Dodecylpyridinium$^+$, |
| C6 | Li-12-Crown-4$^+$, | C13 | Dodecyltrimethyl-ammonium$^+$, |
| C | Na-15-Crown-5$^+$, | | |

-continued $C^{14}$ 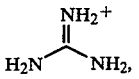

$C^{19}$ 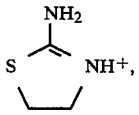

$C^{15}$ 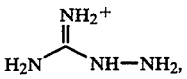

$C^{20}$ 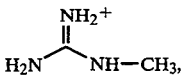

$C^{16}$ 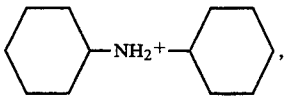

$C^{21}$ 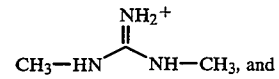

$C^{17}$ 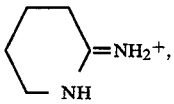

$C^{22}$ 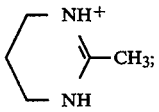

$C^{18}$ 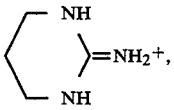

A1, 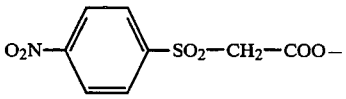

A2, 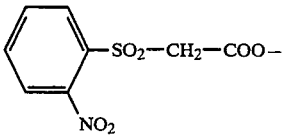

A3, 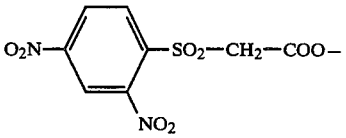

A4, 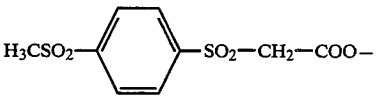

A5, 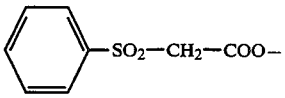

A6, and 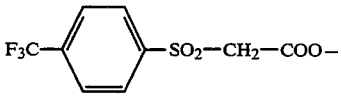

A7. 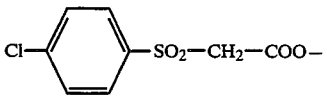

10. The thermal-dye-bleach layer according to claim 1 wherein said dye is selected from the group consisting of polymethine dyes, auramine dyes, tricyanovinyl dyes, disulfone dyes, and styryl dyes.

11. The thermal-dye-bleach layer according to claim 1 which further comprises an acid.

12. The thermal-dye-bleach layer according to claim 11 in which said acid comprises phenylsulfonylacetic acid or a substituted phenylsulfonylacetic acid.

13. The thermal-dye bleach layer according to claim 12 in which said acid is derived from acidification of the anions selected from the group consisting of A1 to A7:

A1 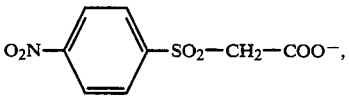

A2 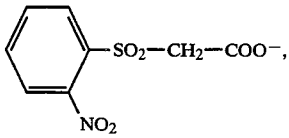

A3 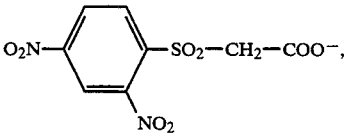

A4 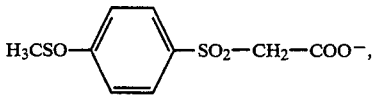

A5 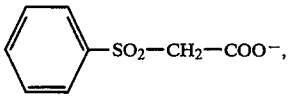

A6 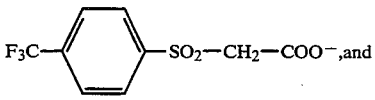

A7 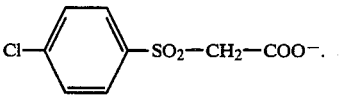

14. The thermal-dye-bleach layer according to claim 11 in which said acid is in the form of an acid-salt.

15. A photothermographic or photographic element comprising:

a support bearing an electromagnetic-radiation-sensitive a photothermographic or photographic silver halide material; and an antihalation layer or acutance agent which comprises:

(a) a thermal bleachable dye in association with a thermally-generated-bleaching agent, and (b) at least one compound selected from the group consisting of:

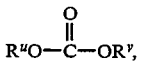

(i)

-continued (ii)

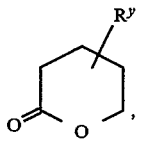

(iii)

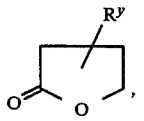

(iv)

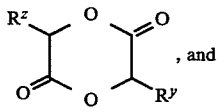

, and (v)

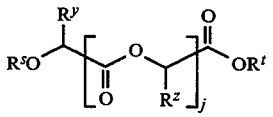

wherein:

$R^s$ is selected from alkyl, aralkyl, cycloalkyl, alkenyl and acyl groups of up to 20 carbon atoms, aryl groups of up to 14 carbon atoms, and hydrogen;

$R^t$ is selected from alkyl, aralkyl, cycloalkyl, and alkenyl groups of up to 20 carbon atoms, and aryl groups of up to 14 carbon atoms;

$R^u$ to $R^v$ are each independently selected from alkyl, aralkyl, cycloalkyl, and alkenyl groups of up to 20 carbon atoms, and aryl groups of up to 14 carbon atoms, with the proviso that only one of $R^u$ and $R^v$ may be alkyl;

$R^y$ to $R^z$ are each independently selected from alkyl, aralkyl, and alkenyl groups of up to 20 carbon atoms, aryl groups of up to 14 carbon atoms, and hydrogen; and j is an integer from 0 to 2.000.

16. The thermal-dye-bleach construction according to claim 15 wherein:

$R^s$ is selected from alkyl, aralkyl, cycloalkyl, alkenyl, acyl, and aryl groups of up to 10 carbon atoms, and hydrogen;

$R^t$ is selected from alkyl, aralkyl, cycloalkyl, alkenyl, and aryl groups of up to 10 carbon atoms;

$R^u$ to $R^v$ are each independently selected from alkyl, aralkyl cycloalkyl, alkenyl, and aryl groups of up to 10 carbon atoms; and $R^y$ to $R^z$ are each independently selected from alkyl, aralkyl, alkenyl, and aryl groups of up to 10 carbon atoms, and hydrogen.

17. The thermal-dye-bleach construction according to claim 16 wherein:

$R^s$ is selected from alkyl, aralkyl, cycloalkyl, alkenyl, and acyl groups of up to 5 carbon atoms, aryl groups of up to 6 carbon atoms, and hydrogen;

$R^t$ is selected from alkyl, aralkyl, cycloalkyl, and alkenyl groups of up to 5 carbon atoms, and aryl groups of up to 6 carbon atoms;

$R^u$ to $R^v$ are each independently selected from alkyl, aralkyl cycloalkyl, and alkenyl groups of up to 5 carbon atoms, and aryl groups of up to 6 carbon atoms; and $R^y$ to $R^z$ are each independently selected from alkyl, aralkyl, and alkenyl groups of up to 5 carbon atoms, aryl groups of up to 6 carbon atoms, and hydrogen.

18. The thermal-dye-bleach construction according to claim 15 wherein:

$R^s$ is selected from hydrogen, methyl, ethyl, and acetyl;

$R^t$ is a fluorinated alkyl group;

$R^u$ and $R^v$ are each independently aryl groups of up to 10 carbon atoms; and $R^y$ and $R^z$ are each independently selected from alkyl groups of up to 5 carbon atoms and hydrogen.

19. The thermal-dye-bleach construction according to claim 15 wherein said at least one compound is selected from the group consisting of poly(lactic acid) and poly(glycolic acid) polymers or copolymers, carbonates, lactones, lactates, lactylates, lactides, glycolates, glycolylates, and glycolides.

20. The thermal-dye-bleach construction according to claim 15 wherein said thermally-generated-bleaching agent is of the of general formula I:

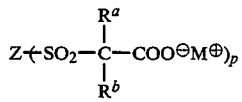

I wherein:

each of $R^a$ and $R^b$ are individually selected from: hydrogen, an alkyl group, an alkenyl group, a cycloalkyl group, an aralkyl group, an aryl group, and a heterocyclic group;

p is one or two, and when p is one, Z is a monovalent group selected from: an alkyl group, a cycloalkyl group, an alkenyl group, an alkynyl group, an aralkyl group, an aryl group, and a heterocyclic group, and when p is two, Z is a divalent group selected from: an alkylene group, an arylene group, a cycloalkylene group, an alkynylene group, an aralkylene group, an alkenylene group, and a heterocyclic group; and $M^+$ is a cation.

21. The thermal-dye-bleach construction according to claim 15 wherein said thermally-generated-bleaching agent comprises a quaternary-ammonium salt of a phenylsulfonylacetic acid which liberates one or more carbanion groups upon thermal decomposition.

22. The thermal-dye-bleach construction according to claim 21 wherein said quaternary ammonium salt of a phenylsulfonylacetic acid is represented by the following formula:

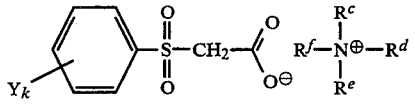

wherein:

Y represents a carbanion-stabilizing group;

k is 0–5; and $R^c$ to $R^f$ are individually $C_1$ to $C_{18}$ alkyl, alkenyl, aralkyl, or aryl group with the proviso that the total sum of carbon atoms contained in $R^c+R^d+R^e+R^f$ will not exceed 22.

23. The thermal-dye-bleach construction according to claim 20 wherein said thermally-generated-bleaching agent comprises a cation selected from the group consisting of C1 to C22 in combination with an anion selected from the group consisting of A1 to A7:consisting of A1 to A7:

| | |
|---|---|
| Tetramethylammonium$^{+}$, | C1 |
| Tetraethylammonium$^{30}$, | C2 |
| Tetrapropylammonium$^{30}$, | C3 |
| Tetrabutylammonium$^{+}$, | C4 |
| Benzyltrimethylammonium$^{+}$, | C5 |
| Li—12—Crown—4$^{+}$, | C6 |
| Na—15—Crown—5$^{+}$, | C |
| K-Dibenzo-18-Crown-6$^{+}$, | C8 |
| K-18-Crown-6$^{+}$, | C9 |
| Tetraphenylphosphonium$^{+}$, | C10 |
| Tetraphenylarsonium$^{+}$, | C11 |
| N-Dodecylpyridinium$^{+}$, | C12 |
| Dodecyltrimethylammonium$^{30}$, | C13 |

C14

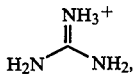

C15

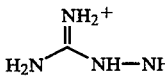

C16

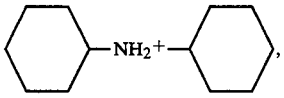

C17

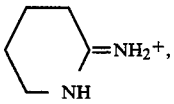

C18

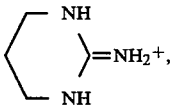

C19

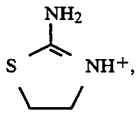

C20

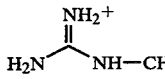

C21

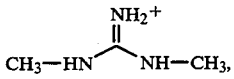

and

-continued

C22

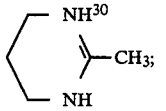

A1

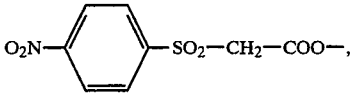

A2

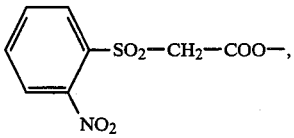

A3

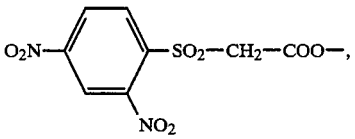

A4

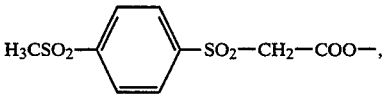

A5

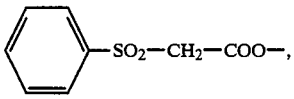

A6

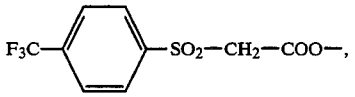

and

A7

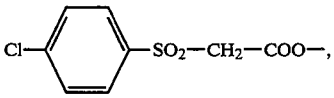

24. The thermal-dye-bleach construction according to claim 15 wherein said dye is selected from the group consisting of polymethine dyes, auramine dyes, tricyanovinyl dyes, disulfone dyes, and styryl dyes.

25. The photothermographic or photographic element as claimed in claim 15 in which said silver halide material is infrared-sensitive.

26. The photothermographic or photographic element as claimed claim 15 in which said silver halide material is a photothermographic medium.

27. The photothermographic or photographic element as claimed in claim 15 in which said antihalation layer or acutance agent contains said dye in an amount to provide an optical density of from 0.05 to 3.0 absorbance units at λmax of the dye.

28. The photothermographic or photographic element as claimed in claim 15 in which said dye is present in an amount ranging from 0.001 to 1 g/m$^{2}$.

* * * * *